US006544569B1

(12) United States Patent
Suzuki et al.

(10) Patent No.: US 6,544,569 B1
(45) Date of Patent: Apr. 8, 2003

(54) RICE BALL WRAPPERS AND RICE BALL PACKAGES

(76) Inventors: Makoto Suzuki, 11-29, Hachimandai, Neyagawa-shi, Osaka (JP); Eiichi Suzuki, 5-6-26-701, Hama, Tsurumi-ku, Osaka-shi, Osaka (JP)

( * ) Notice: Subject to any disclaimer, the term of this patent is extended or adjusted under 35 U.S.C. 154(b) by 184 days.

(21) Appl. No.: 09/658,384

(22) Filed: Sep. 8, 2000

(30) Foreign Application Priority Data

Jul. 13, 2000 (JP) ..... 2000-212151

(51) Int. Cl.[7] ..... B65B 11/00; B65H 45/00; B65D 33/18

(52) U.S. Cl. ..... 426/115; 426/120; 426/121; 426/123; 426/125; 53/429; 53/466

(58) Field of Search ..... 238/200, 207, 238/208; 229/87.08, 87.05; 53/465, 412, 449, 219, 466, 429; 426/115, 123, 120, 410, 110, 121, 125

(56) References Cited

U.S. PATENT DOCUMENTS 4,230,728 A * 10/1980 Tezuka ..... 426/115
4,247,564 A * 1/1981 Tezuka ..... 426/115
4,251,552 A * 2/1981 Uno et al. ..... 426/115
4,251,553 A * 2/1981 Kobayashi ..... 426/115
4,276,321 A * 6/1981 Nagatani ..... 426/618
4,623,568 A * 11/1986 Suzuki ..... 229/87.08
4,801,075 A * 1/1989 Weber et al. ..... 426/123
5,184,771 A * 2/1993 Jud et al. ..... 206/524.2
5,741,533 A * 4/1998 Lorenzo Moore et al. .. 426/105

FOREIGN PATENT DOCUMENTS

JP 07222559 8/1995

* cited by examiner

*Primary Examiner*—Nina Bhat
(74) *Attorney, Agent, or Firm*—Arnold B. Silverman; Brij K. Agarwal; Eckert Seamans Cherin & Mellott, LLC

(57) ABSTRACT

A rice ball wrapper comprises an outer film, an inner film and a sheet of food sandwiched between the two films. The inner film comprising two film pieces having opposed sides lapping over each other at an approximate widthwise mid-portion of the wrapper. The outer film is provided at an approximate longitudinal and widthwise central portion thereof with tabs for tearing the film from the central portion to longitudinal opposite ends thereof. The tabs are formed by an incision made in the film through the thickness thereof.

12 Claims, 14 Drawing Sheets

RICE BALL WRAPPERS AND RICE BALL PACKAGES

FIELD OF THE INVENTION

The present invention relates to rice ball wrappers comprising an inner film, an outer film and a sheet of food, such as a sheet of seaweed, sandwiched between the two films, and rice ball packages prepared by enclosing a rice ball in the wrapper.

BACKGROUND OF THE INVENTION

Cooked rice is molded with the hands into round, triangular or cylindrical shapes to prepare "onigiri" or rice balls. Such cooked rice moldings are herein referred to as "rice balls."

With reference to FIG. 21, wrappers of the type mentioned comprise a rectangular outer film 1, an inner film 2 composed of two film pieces 21, 21 and a sheet of seaweed 8 sandwiched between the two films.

To prepare a rice ball package with use of the wrapper, cooked rice is molded into a triangular shape to obtain a triangular rice ball 4, on which the wrapper 5 is placed. The triangular rice ball 4 is then enclosed in the wrapper 5 while folding the wrapper 5 downward along the three sides of the rice ball 4.

The overlapping four corners of the wrapper 5 are folded over onto the rear side of the rice ball, and the resulting laps are thermally bonded or fastened with a seal 7 shown in FIG. 23.

To eat the rice ball, a tab 11 formed at the vertex of front surface of the rice ball package is pulled to the base of the triangular rice ball to tear the outer film 1 as shown in FIG. 22, the tab 11 is further pulled toward the vertex on the rear surface of the package to tear the outer film 1 longitudinally thereof. The opposite outer film portions torn apart are thereafter pulled away from each other laterally.

The film pieces 21, 21 of the inner film 2 of FIG. 21 are also pulled apart laterally along with the opposite outer film portions and removed from the triangular rice ball 4, whereby the triangular rice ball 4 is covered directly with the sheet of seaweed 8.

However, the conventional rice ball package has the following problems.

It is likely that a label 7 bearing the commodity name or the like printed thereon will be affixed to the outer film 1 as shown in FIG. 23. In this case, a tearing piece 12 in the form of a narrow strip and formed by pulling the tab 11 encounters resistance when moving past the label 7 and is thereby made narrower to become torn off while being pulled, failing to divide the outer film in two into opposite portions. Thus , frequently experienced is the problem that the package can not be opened smoothly.

It is also likely that the three corners of the rice ball package shown in FIG. 22 are sealed off by thermal bonding to prevent ingress of extraneous matter into the package from outside. However, the tab 11 will then be bonded, presenting difficulty in separating the outer film into two opposite side portions. Especially when the rice ball package has the label 7 affixed to the outer film 1, the film is difficult to divide into two opposite side portions.

An object of the present invention is to provide a wrapper which is free of the foregoing problems and a rice ball package prepared with use of the wrapper.

SUMMARY OF THE INVENTION

The present invention provides a wrapper which comprises an outer film 1, an inner film 2 and a sheet of food 8 sandwiched between the two films. The inner film 2 comprises two film pieces 21, 21 having opposed sides lapping over each other approximately at the widthwise midportion of the wrapper as shown in FIG. 2. The outer film 1 is provided, approximately at the longitudinal and widthwise central portion thereof, with tabs 9, 9 for tearing the film symmetrically from the central portion to respective longitudinal opposite ends thereof. The tabs 9 are formed by an incision 90 made in the film 1 through the thickness thereof.

To package a triangular rice ball 4 with the wrapper, the rice ball 4 is so positioned relative to the wrapper that approximately at the central portion of the wrapper, one side of the triangular rice ball 4 is orthogonal to the longitudinal direction of the wrapper. The rice ball 4 is so enclosed in the wrapper that the lap 20 of the film pieces 21, 21 of the inner film 2 extends from the vertex of the rice ball 4 toward the midportion of the side opposite to the vertex.

A label 7 is affixed to the outer film 1 across the direction in which the tab 9 is to be torn. The distance L from the label 7 to the vertex of the triangular rice ball 4 is shorter than the distance Ll from the vertex of the rice ball 4 to the midportion of the side thereof opposite to the vertex (see FIG. 3).

The tabs 9, 9 for tearing the outer film 1 are provided at the approximate longitudinal midportion of the film, and the rice ball 4 is so packaged with the wrapper that one side of the rice ball is orthogonal to the longitudinal direction of the wrapper at the approximate longitudinal midportion thereof. Accordingly when the rice ball package is displayed in an upright position with the triangular surfaces thereof positioned respectively as the front and rear sides thereof, the tabs 9 are out of sight, as positioned on the bottom side of the package. The tabs 9 therefore will not impair the appearance of the rice ball package.

Further when such rice ball packages are to be placed on sale, the packages are so displayed that the tabs 9 are positioned on the bottom side of the package. The ingress of the outside air through the incision 90 forming the tabs 9 can then be prevented to protect the sheet of food 8 from moisture.

When the rice ball is to be eaten, the tabs 9, 9 of the rice ball package are pulled toward the vertex of the package on the front and rear sides thereof.

In the case where a label 7 is affixed to each of the front and rear surfaces of the rice ball package, the label is likely to offer resistance to the tearing of the outer film of the package by the tab 9. However, since the distance L from the label 7 to the vertex of the package is small, a tear extends to the vertex before an extension of the tab 9 is torn off during tearing, dividing the outer film 1 into two opposite side portions.

When the divided portions of the outer film 1 are pulled away from each other laterally, the film pieces 21, 21 of the inner film 2 are pulled along with the divided outer film portions, slipping out from between the sheet of food 8 and the rice ball 4 to become removed from the rice ball 4, whereby the rice ball 4 is covered directly with the sheet of food 8.

With reference to FIG. 14, the present invention provides another rice ball package prepared with use of a wrapper 5. The wrapper 5 comprises an outer film 1 having a discrete incision 15 formed in an approximate widthwise midportion thereof and extending over the entire length of the film 1 longitudinally thereof, and an intermediate film 3 interposed between the outer film 1 and a sheet of food 8 and extending beneath the discrete incision 15 of the outer film 1. The wrapper 5 has a cut portion 16 formed by cutting off a corner and to be finally folded over a triangular surface of a triangular rice ball.

As shown in FIG. 18, a label 7 is provided at opposite ends of the rear surface thereof with respective adhesive layers 73, 73, one of which is fitted over the cut portion 16 of the wrapper 5. The label 7 is centrally formed with a discrete incision 74 in alignment with the incision 15 of the outer film 1. The wrapper 5 is sealed at ear portions 19, 19, 19 projecting outward from the respective three vertices of the triangular rice ball 4.

These ear portions 19 of the rice ball package, which are sealed,.diminish the likelihood of extraneous matter ingressing into the package through the ear portions 19.

The outer film 1 has the discrete incision 15, so that when the two ear portions 19, 19 positioned on opposite sides of the incision 15 are pulled outward away from each other with the hands, the outer film 1 and the inner film 2 are subjected to forces acting thereon to separate these films in opposite directions widthwise thereof. These forces will not act on the sheet of food 8 since the ear portions 19, 19 have no portion of the food sheet 8 incorporated therein, and the triangular rice ball is covered directly with the sheet of food 8.

Thus, the rice ball package can be opened by the single action of pulling the opposite ear portions 19, 19 outward.

DETAILED DESCRIPTION OF THE PREFERRED EMBODIMENTS

Embodiments of the invention will be described below in detail with reference to the drawings.

(First Embodiment)

This embodiment is characterized in that an outer film 1 has tabs 9 as will be described below.

Figure 1:
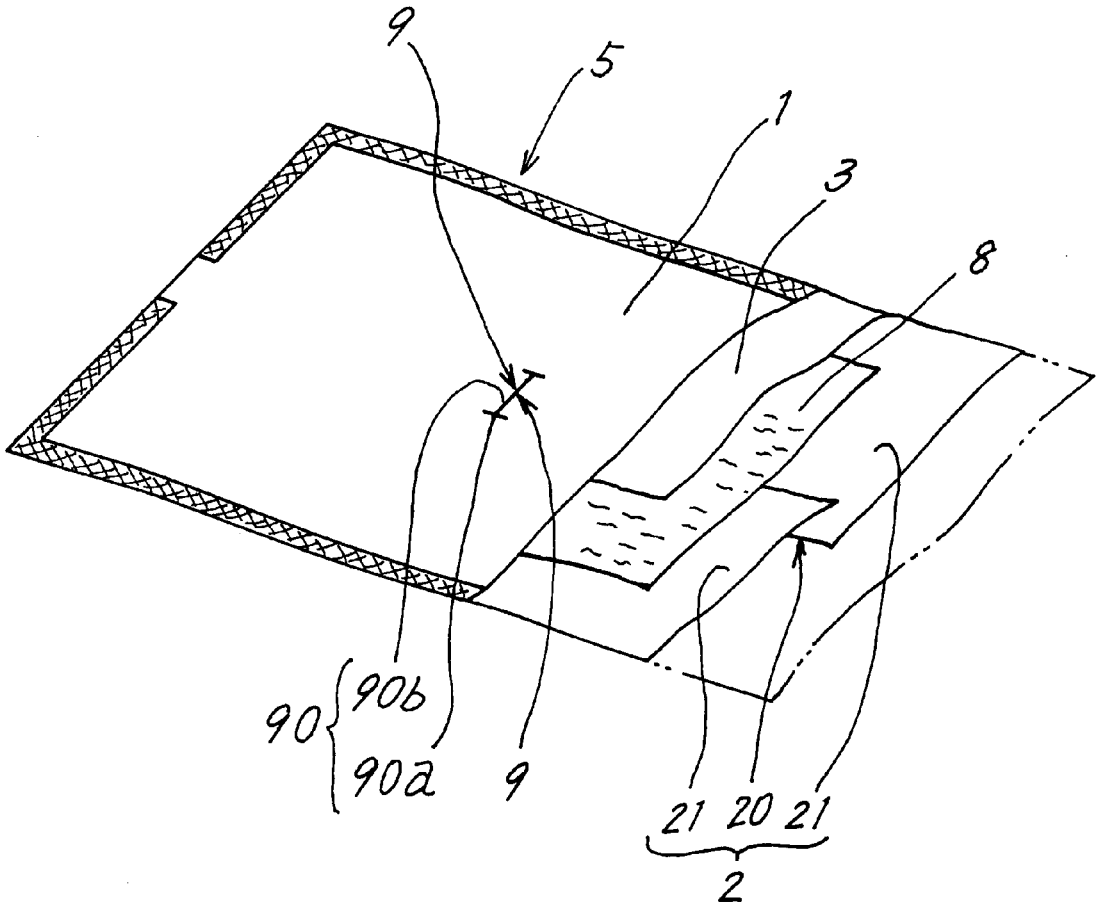
FIG. 1 is a perspective view partly broken away and showing a wrapper.
Figure 2:
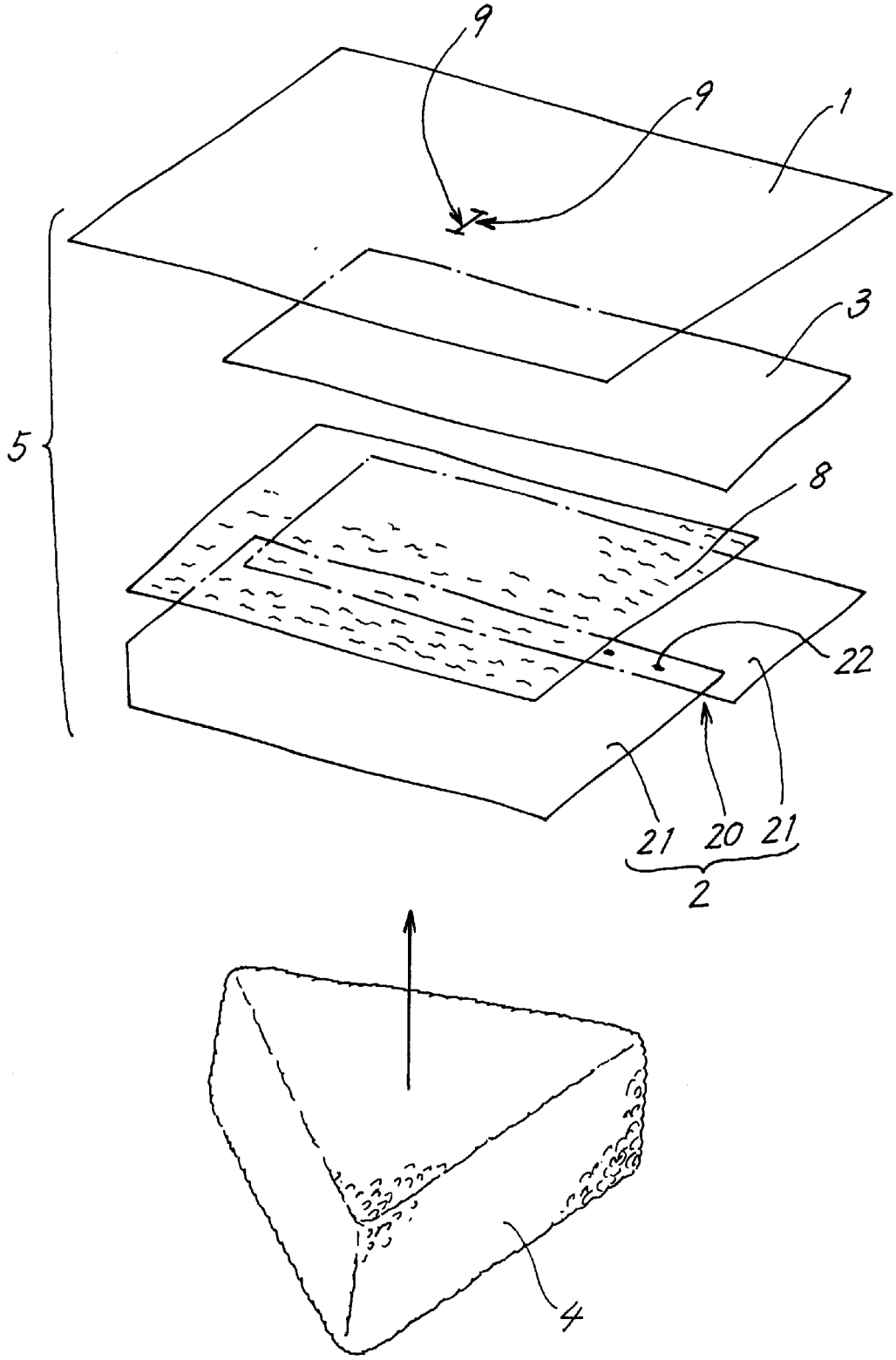
FIG. 2 is an exploded perspective view of the wrapper.

With reference to FIGS. 1 and 2, a wrapper 5 comprises the outer film 1, an inner film 2, and a sheet of food 8, such as a sheet of seaweed, sandwiched between the two films. The embodiment further comprises an intermediate film 3 interposed between the outer film 1 and the sheet of food 8.

The outer film 1 is an oriented film which is generally rectangular, measures about 220 mm in length and about 140 mm in width and is easy to tear longitudinally thereof.

The outer film 1 is provided with two tabs 9, 9 at its approximate longitudinal and widthwise central portion for tearing the film longitudinally thereof.

The tabs 9, 9 shown in FIGS. 1 and 2 are formed by making an incision 90 in the film through the thickness thereof.

The incision 90 comprises two longitudinal lines 90*a*, 90*a* along the longitudinal direction of the outer film 1, and a lateral line 90*b* interconnecting the longitudinal lines and extending widthwise of the film 1. In length, the longitudinal lines 90*a*, 90*a* are about 5 mm, and the middle lateral line 90*b* is 5 to 15 mm.

The inner film 2 comprises a pair of rectangular film pieces 21, 21 of approximately the same size. The two film pieces 21, 21 have opposed side edges extending longitudinally of the film 2 and lapping over each other to form a lap 20 of about 7 mm in width. The inner film 2 is so sized as to be exactly coextensive with the outer film 1.

According to the present embodiment, the two film pieces 21, 21 are thermally bonded to each other easily separably at the widthwise midportion of the lap 20, in the form of spots as arranged longitudinally of the film 2 as shown in FIG. 2.

The intermediate film 3 has a length of about 220 mm, i.e., the same length as the outer and inner films 1, 2, and has a width slightly greater than one-half of the width of the outer film 1.

The intermediate film 3 and the inner film 2 are made of a moisture-proof film.

(Preparation of Rice Ball Package)

A rice ball is packaged by the following procedure.

With reference to FIG. 2, an outer film 1 is placed over an inner film 2 with their contours in register with each other and with a sheet of food 8 interposed between the two films. An intermediate film 3 is further interposed between the outer film 1 and the food sheet 8, with one long side edge of the film 3 in register with one long side edge of each of the outer and inner two films 1, 2, and the resulting assembly is thermally bonded along the outer peripheral edge thereof.

The film assembly is not bonded over the entire outer periphery thereof; it is thermally bonded except at the lap 20 of the film pieces 21, 21 and in the vicinity thereof.

A triangular rice ball 4 is placed on the wrapper 5 thus prepared over the lap 20 of the inner film 2 thereof. The rice ball 4 is so positioned that one side thereof is orthogonal to the longitudinal direction of the wrapper 5, and the wrapper 5 is fitted over the rice ball 4 to package the ball with the wrapper 5 by the same procedure as used for the conventional package of FIG. 22.

Figure 3:
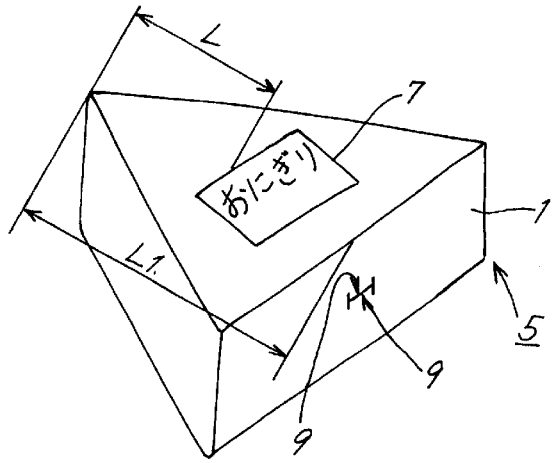
FIG. 3 is a perspective view showing the front side of a rice ball package.
Figure 4:
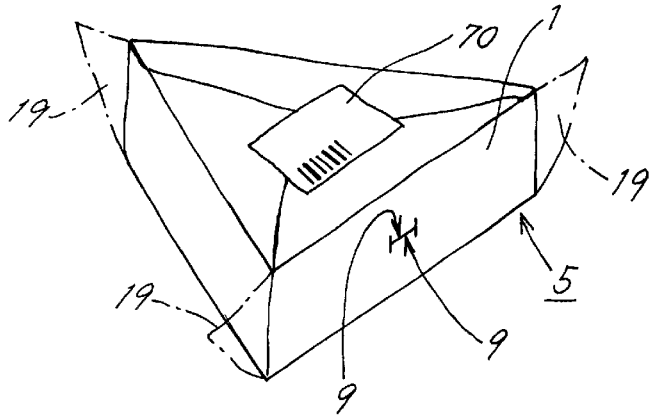
FIG. 4 is a perspective view showing the rear side of the rice ball package.

A label 7 bearing the commodity name, etc. printed thereon is affixed to the triangular front surface of the package as shown in FIG. 3. A rear label 70 bearing a bar code, price, date of production, etc. printed thereon is affixed to the triangular rear surface as seen in FIG. 4. The distance L from the label 7 of FIG. 3 to the vertex of the triangular rice ball 4 is smaller than the distance L1 from the vertex of the rice ball 4 to the midportion of the side thereof opposite to the vertex. The label 7 is affixed to the outer film 1 across the direction in which the tab 9 is to be torn. The tabs 9, 9 of the outer film 1 are positioned on the bottom side of the rice ball 4.

The tabs 9, 9 for tearing the outer film 1 are provided approximately at the longitudinal midportion of the outer film 1. The rice ball 4 has its one side positioned in parallel to the short side of the wrapper 5 at the approximate longitudinal midportion of the wrapper 5. Accordingly, when the rice ball package is displayed in an upright position with its triangular surfaces positioned as the front and rear sides, the tabs 9 are out of sight as positioned on the bottom side of the rice ball and will not impair the appearance of the rice ball package.

Further if the package is displayed with the tabs 9 positioned on the bottom side thereof, the outside air can be prevented from penetrating into the package through the incision 90 providing the tabs 9. Moreover, the intermediate film 3 included in the embodiment and preventing the ingress of the outside air through the incision 90 more effectively protects the sheet of food 8 from moisture.

The wrapper 4 forms projecting ear portions 19, 19, 19 at the three corners of the rice ball package as indicated in chain lines in FIG. 4 although these portions are not described with reference to the embodiment. These ear portions 19 may be closed by thermal bonding since extraneous matter is likely to ingress into the package through the ear portions 19.

Figure 22:
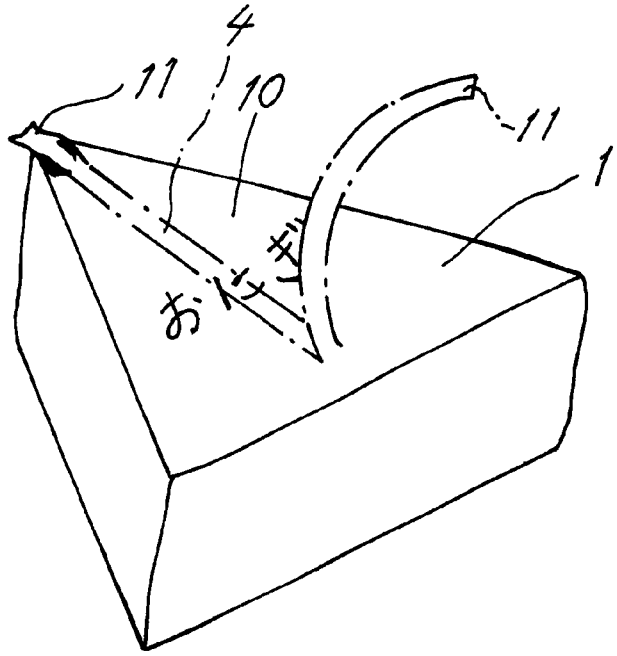
FIG 22 PRIOR ART
FIG. 22 is a perspective view of a conventional rice ball package.
Figure 23:
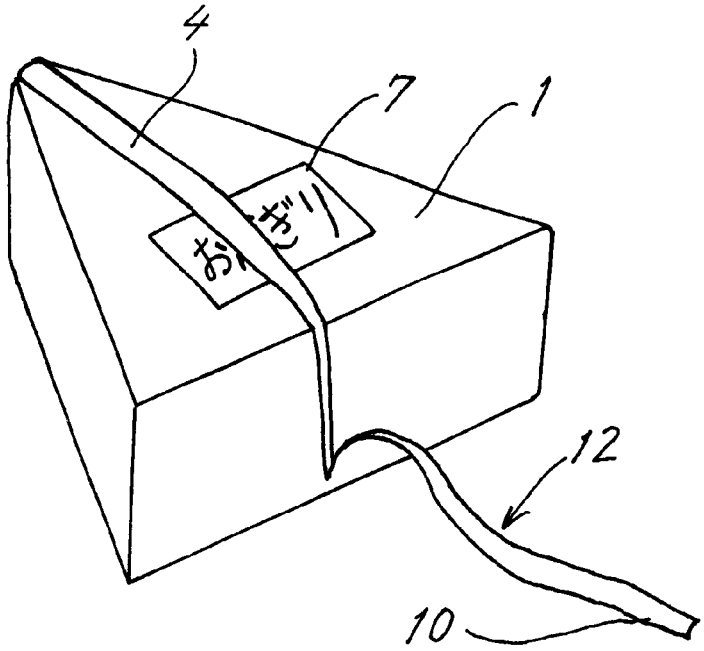
FIG 23 PRIOR ART
FIG. 23 is a perspective view of another conventional rice ball package.

If the projecting ear portion is thermally bonded for preventing the ingress of extraneous matter in the case of the conventional package of FIG. 22, the tab 11 becomes bonded and no longer usable as the tab 11 for opening the package, whereas with the rice ball package of the invention, the package can be opened with the tabs 9 even if the projecting ear portions 19 are closed by thermally bonding.

Tearing of Wrapper

Figure 5:
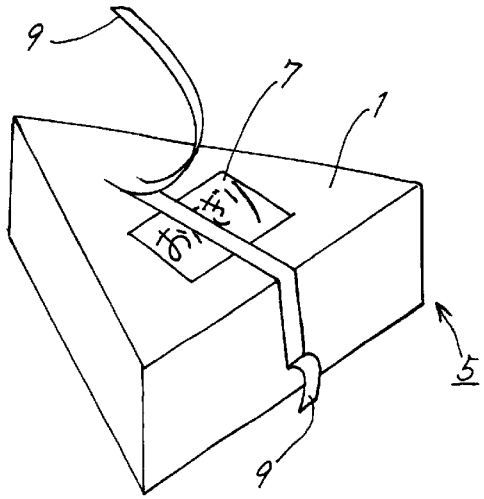
FIG. 5 is a perspective view showing the rice ball package while it is being unwrapped.

When the rice ball is to be eaten, the tabs 9, 9 shown in FIGS. 4 and 5 are pulled toward the vertex of the rice ball package on the front side and the rear side thereof, respectively. The tab 9 extends along the surface of the outer film 1 while tearing the outer film 1.

The labels 7, 70 affixed to the front and rear surfaces of the rice ball package offer resistance to the tearing of the extension of each tab 9, making the extension narrower. However, since the distance L from the label 7 to the vertex of the package is small, the tear extends to the vertex before the extension of the tab 9 is torn off during tearing as shown in FIG. 5, dividing the outer film 1 into two opposite side portions.

When the divided portions of the outer film 1 are pulled away from each other laterally, the film pieces 21, 21 of the inner film 2 shown in FIG. 2 are pulled along with the divided outer film portions, slipping out from between the sheet of food 8 and the rice ball 4 to become removed from the rice ball 4.

Consequently, the rice ball 4 is covered directly with the food sheet 8.

Figure 6A:
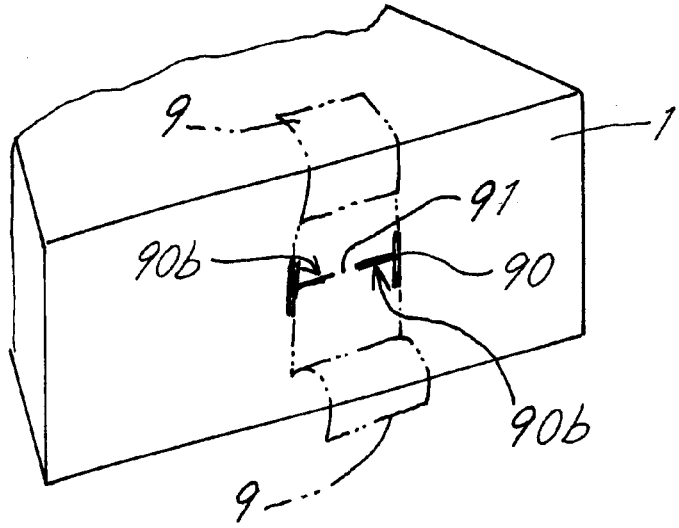
FIGS. 6A, 6B and 6C are enlarged views showing other examples of tabs formed in outer films.
Figure 6B:
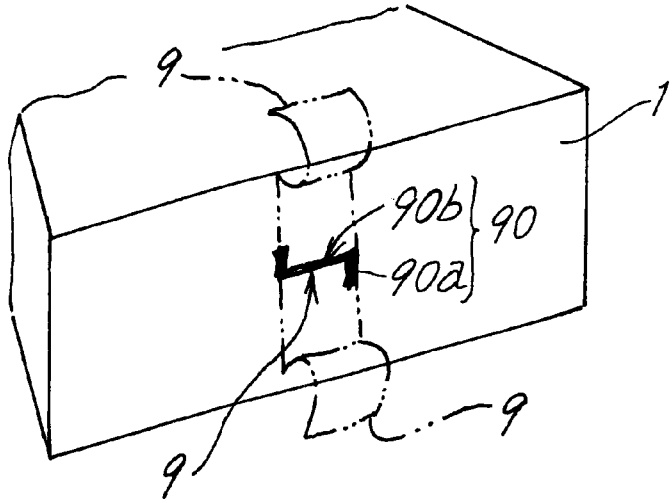
Figure 6C:
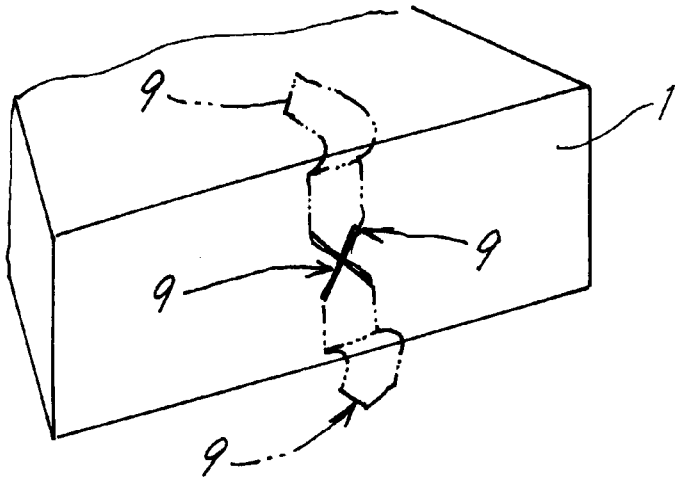

FIGS. 6A, 6B and 6C show other examples of tabs 9 of the outer film 1.

FIG. 6A shows an incision 90 having a lateral line 90*b* which is discontinuous at one portion as at 91. This discontinuous portion 91 serves to prevent tabs 9 from becoming turned up spontaneously before the package is opened.

FIG. 6B shows an incision 90 comprising a lateral line 90*b*, and parallel longitudinal lines 90*a*, 90*a* extending from the respective ends of the line 90*b* in opposite directions to each other. In FIG. 6B, the lateral line 90*b* only can be formed, with the parallel longitudinal lines 90*a*, 90*a* omitted.

Having the property to tear longitudinally thereof, the outer film 1 can be torn from the bottom side of the rice ball package to the vertex thereof as shown in FIGS. 6A, 6B or 6C without the likelihood of the lateral incision stretching.

FIG. 6C shows an X-shaped incision made in an outer film 1 to form two tabs 9, 9.

Figure 7:
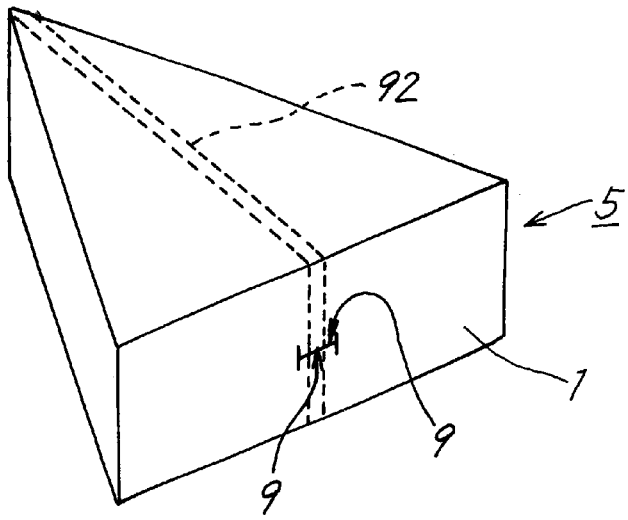
FIG. 7 is a perspective view of another example having a tear tape.

FIG. 7 shows a tear tape 92 widely known for use with cigarette packages. The tape 92, which is a narrow tape of resin film, is joined to a wrapper 5 at its center longitudinally thereof. The outer film 1 can be torn apart by pulling one end of the tape 92.

The tear tape 92 is applied to the outer film 1 to extend longitudinally thereof over the entire length at the approximate widthwise midportion of the film, and is cut at the location of a tab 9.

When the tab 9 is pulled, the tear tape 92 is also pulled at the same time, whereby the outer film can be divided in two neatly. In this case, the outer film need not be an oriented film having a predetermined direction of tearing.

(Second Embodiment)

Figure 8:
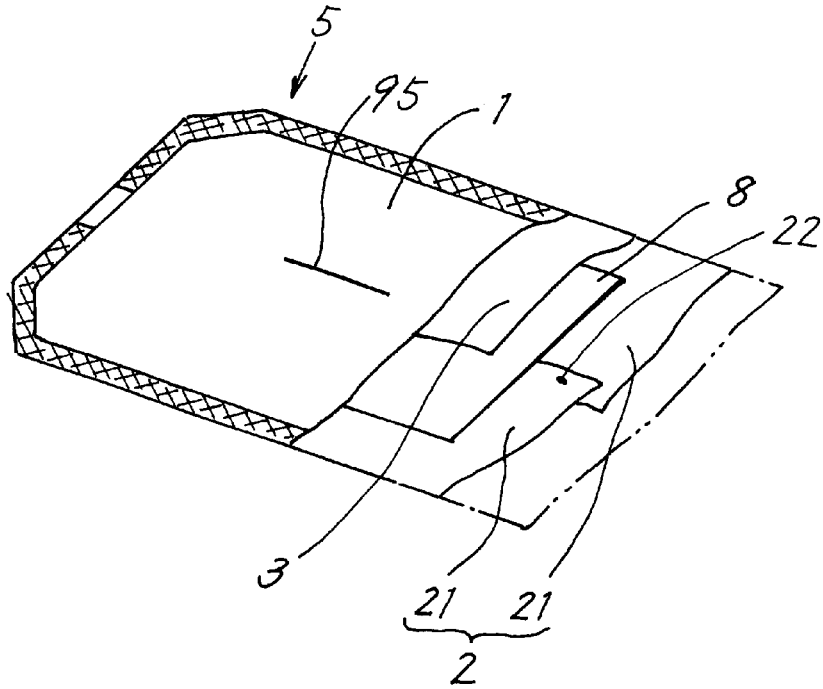
FIG. 8 is a perspective view partly broken away and showing a wrapper of another embodiment.

This embodiment, i.e., wrapper 5, is characterized in that an outer film 1 is formed with a cut line 95 instead of the tab 9 as shown in FIG. 8.

The cut line 95 is formed in the outer film 1 longitudinally thereof approximately at its longitudinal and widthwise central portion.

The cut line 95 has a length slightly larger than the width of the bottom side of the triangular rice ball 4 to be packaged, i.e., a length of 35 to 40 mm according to the present embodiment. The embodiment further comprises an inner film 2, an intermediate film 3 and a sheet of food 8 which are in the same arrangement as in the first embodiment.

Figure 9:
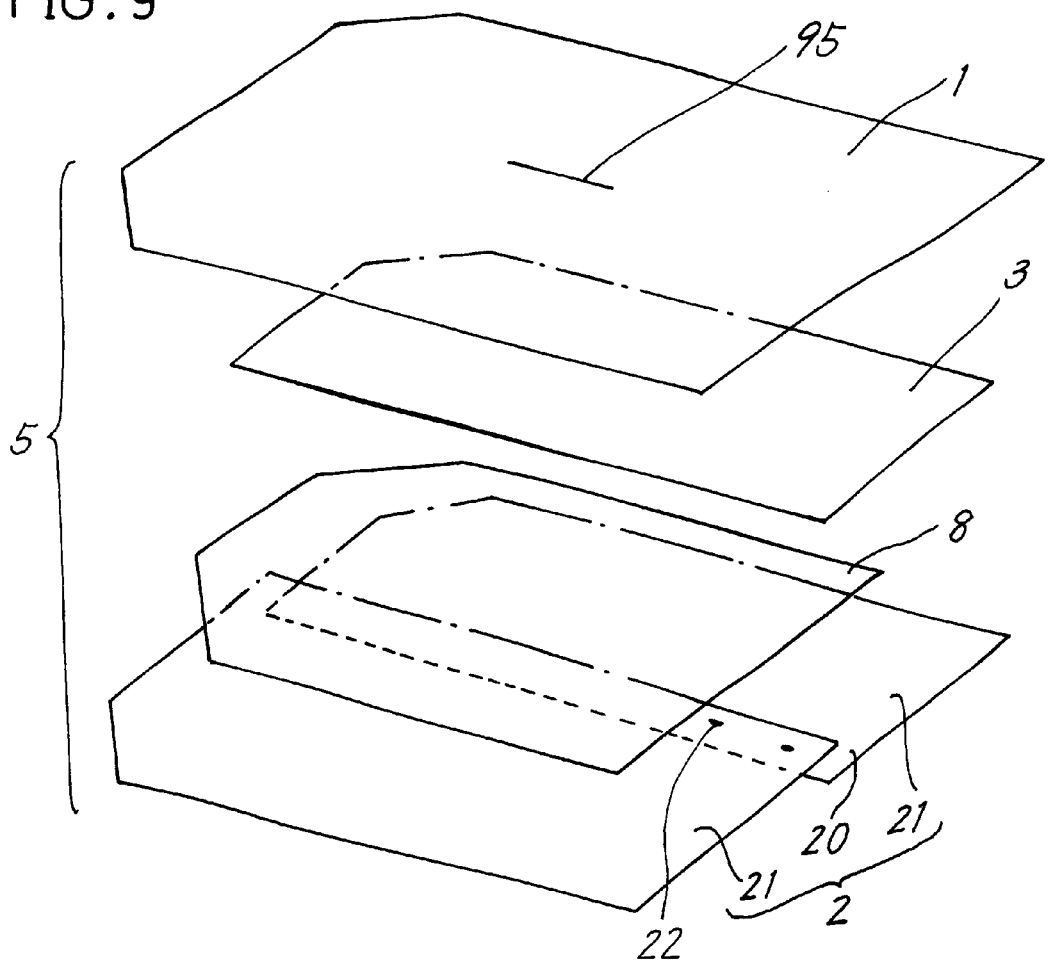
FIG. 9 is an exploded perspective view of the wrapper of FIG. 8.
Figure 9:
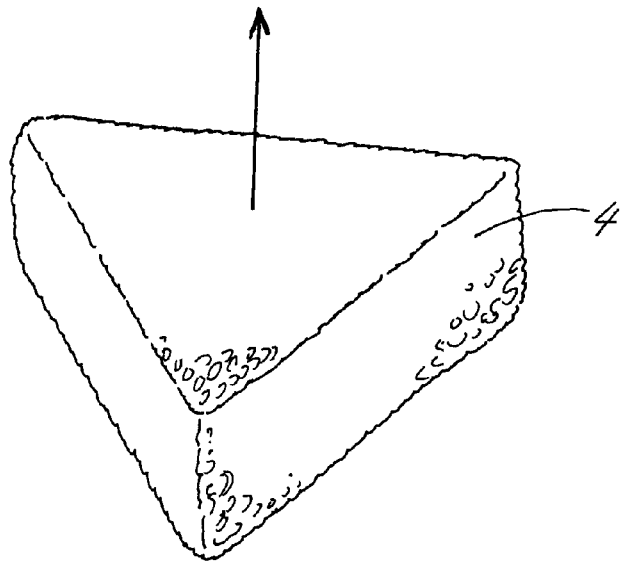

With reference to FIG. 9, the triangular rice ball 4 is so positioned relative to the wrapper 5 that one side of the rice ball 4 is orthogonal to the longitudinal direction of the wrapper at the approximate longitudinal midportion of the inner film 2 of the wrapper 5. The wrapper is fitted over the front and rear surfaces of the rice ball 4, which is then packaged with the wrapper by the same procedure as used for the first embodiment.

Since the cut line 95 of the outer film 1 has a length slightly larger than the width of the bottom side of the rice all 4, opposite ends of the cut line 95 extend to the opposite triangular sides of the rice ball a short distance.

Figure 10:
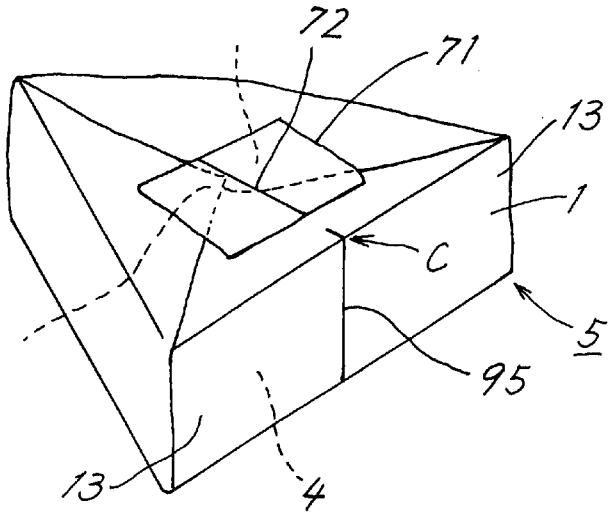
FIG. 10 is a perspective view of the rear side of a rice ball package.

After the triangular rice ball 4 is enclosed in the wrapper 5, the wrapped rice ball is turned upside down, and opposite overlapping ear portions 50, 50 of the wrapper are fastened with a seal 71 as shown in FIG. 10. For packaging, the opposite overlapping ear portions 50, 50 of the wrapper may be fastened by thermal bonding.

It is required that the seal 71 be formed with a score 72 in alignment with the cut line 95 of the outer film 1, so that the seal 71 can be torn apart along the score 72 with the outer film 1 when the outer film 1 is torn apart along the cut line 95.

When the rice ball is to be eaten, opposite ends 13, 13 (see FIG. 10) of the outer film 1 of the wrapper are pulled away from the cut line 95 of the film 1 laterally in opposite directions. The outer film 1 is an oriented film which is easy to tear longitudinally thereof, with the result that the cut line 95 lengthens to tear the outer film 1 into two opposite side portions.

When the opposite ends of the outer film 1 are pulled laterally in opposite directions, a stress readily concentrates on the corner (indicated at C in FIG. 10) where the portions of the film corresponding to the bottom side and the triangular side of the rice ball meet, and the cut line 95 is formed beyond the corner C, so that the force acts effectively on the cut line 95. The outer film can therefore be torn apart easily and neatly.

As is the case with the first embodiment, the rice ball 4 is covered directly with the sheet of food 8 and can be eaten as covered with the food sheet 8 which remains free from moisture.

The cut line 95 shown in FIG. 10 is formed in the outer film 1 at the approximate longitudinal midportion thereof only, while the rice ball 4 is so packaged that one side thereof is orthogonal to the longitudinal direction of the wrapper 5 approximately at the longitudinal midportion thereof. Accordingly, if such rice ball packages are displayed in an upright position, with the cut-line side down, the cut line 95 is almost out of sight as positioned on the bottom side of each rice ball. Short opposite end portions only of the cut line 95 are visible from outside the wrapper 5; the presence of the cut line 95 will not impair the appearance of the rice ball package.

When such rice ball packages are on display, the cut line 95 is positioned on the bottom side of each package. This greatly reduces the likelihood of the outside air ingressing into the package through the cut line 95. Shortening the cut line 95 is more effective for preventing the ingress of the outside air. For this reason, the intermediate film 3 for preventing the ingress of the outside air need not be composed of two film pieces lapping over each other at their inner side edges but can be a single film extending beneath the cut line 95.

Figure 11:
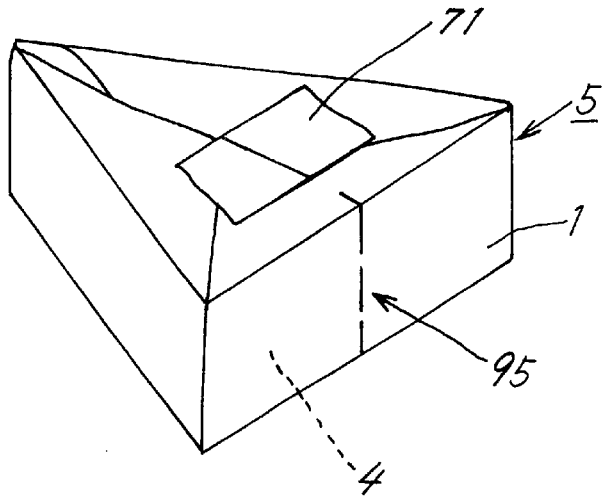
FIG. 11 is a perspective view of a rice ball package wherein a discrete cut line is formed in the outer film.

FIG. 11 shows another example of outer film 1, which has a discrete cut line 95.

Figure 12:
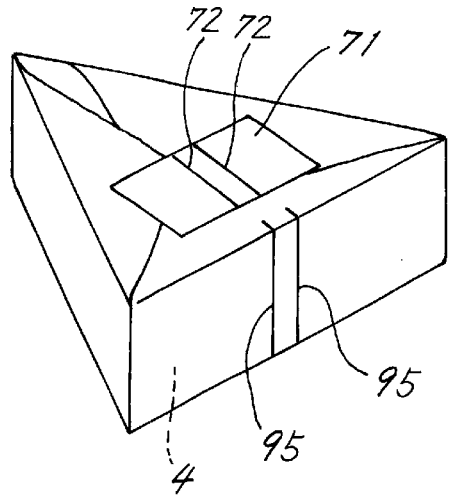
FIG. 12 is a perspective view of the rear side of a rice ball package wherein a plurality of cut lines are formed in the outer film.

FIG. 12 shows another example of outer film 1 having two parallel cut lines 95 arranged close to each other. At least three cut lines 95 may be provided. In the case where a plurality of cut lines 95 are provided, each cut line 95 can be discrete as shown in FIG. 11.

Figure 13:
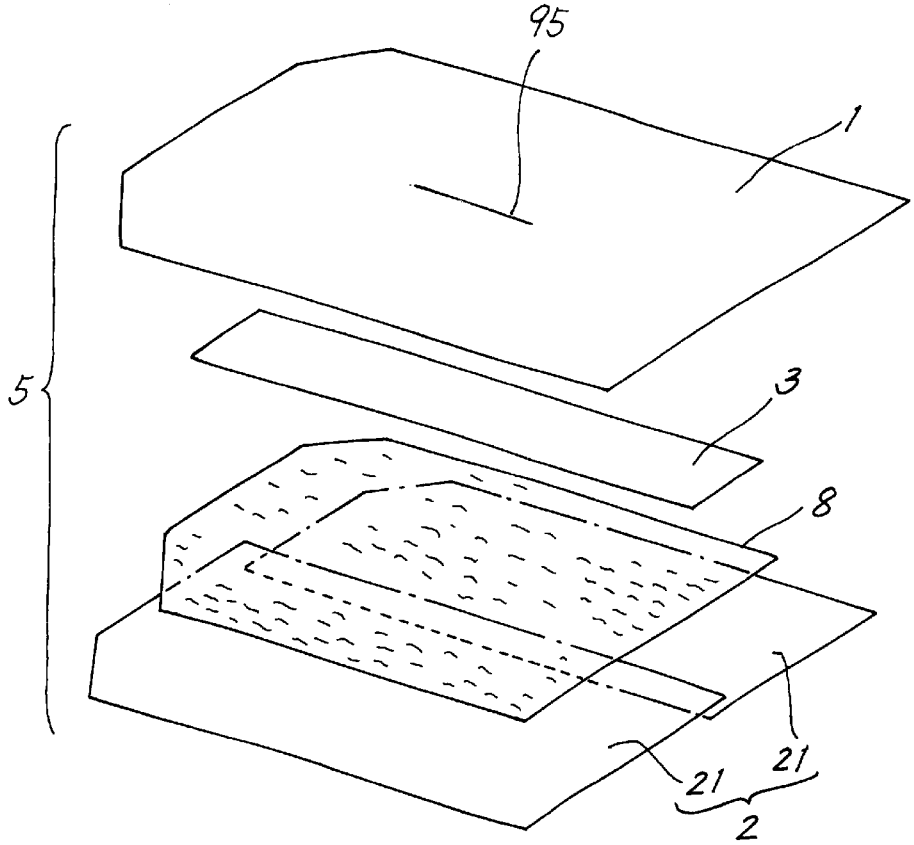
FIG. 13 is an exploded perspective view of a wrapper including an intermediate film of reduced width.

FIG. 13 is an exploded perspective view of a wrapper 5 which includes an intermediate film 3 having a reduced width and positionable beneath the outer film portion formed a cut line 95.

Incidentally, rice ball packages placed on sale at convenience stores and the like are characterized by a rapid turnover of merchandise, while the packages out of expiry date are discarded, such that rice ball packages are not allowed to stand for a long period of time. Accordingly, the sheet of food 8 will not become damp noticeably even if the intermediate film 3 is dispensed with. An intermediate film is of course usable which comprises two film pieces.

(Third Embodiment)

Figure 14:
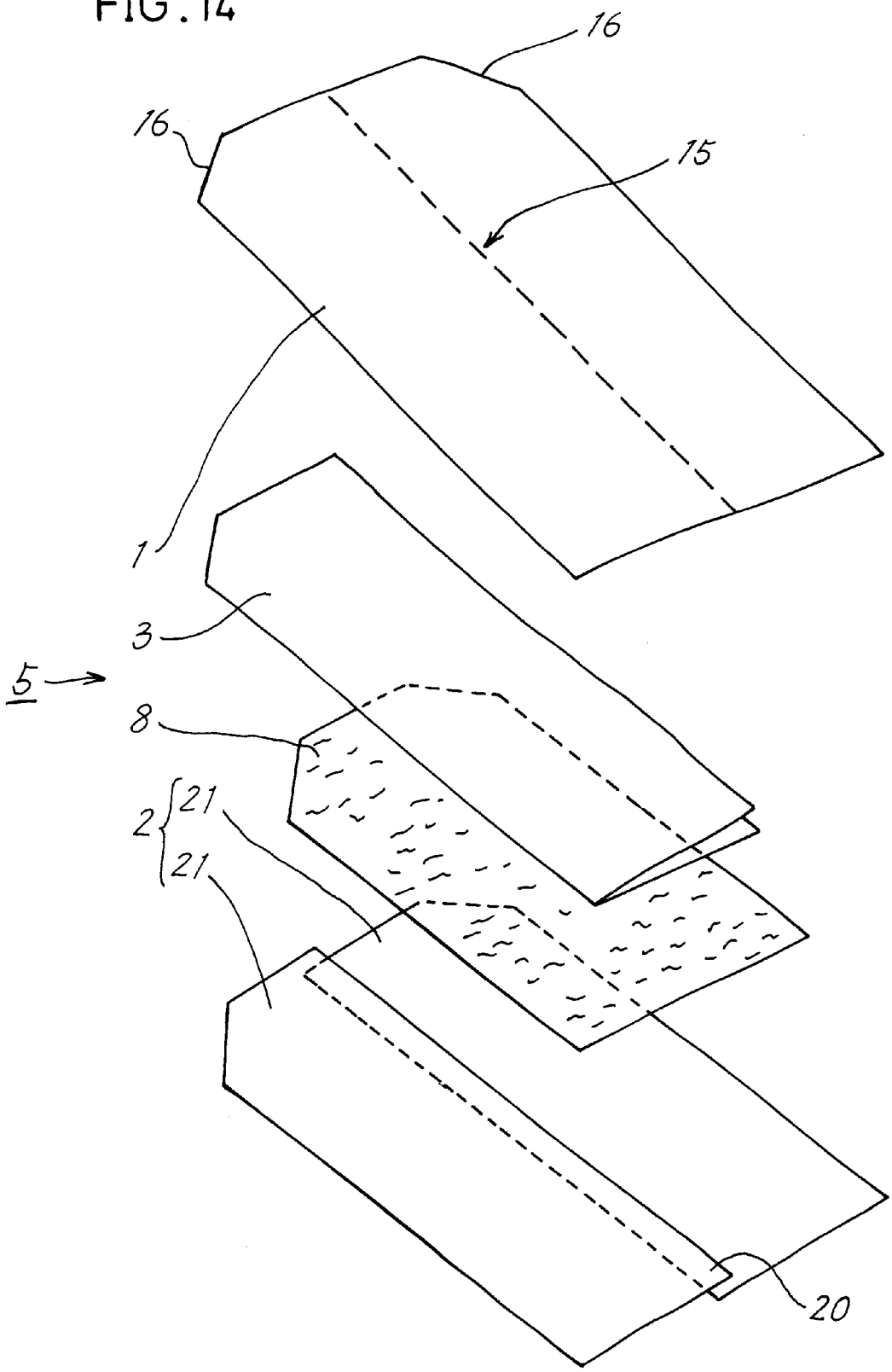
FIG. 14 is an exploded perspective view of a wrapper of another embodiment.

With reference to FIG. 14, this embodiment is characterized in that an outer film 1 has a discrete incision 15 formed in the approximate widthwise midportion thereof and extending over the entire length of the film 1.

More specifically, a wrapper 5 comprises an outer film 1 formed with a discrete incision 15 over the entire length thereof, an intermediate film 3, a sheet of food, i.e., of seaweed, 8 and an inner film 2.

The corners of one end of the outer film 1 are cut off as at 16, thereby permitting a label 7 to be affixed to the outer film 1 over an increased area as will be described later.

The inner film 2 comprises generally rectangular two film pieces 21, 21 having approximately the same size and longitudinal inner edges lapping over each other, and has an overall contour in match with the contour of the outer film 1.

The sheet of food 8 is cut to a rectangular shape and has a substantially smaller size than the outer film 1 and the inner film 2.

The intermediate film 3 is generally identical with one of the film pieces 21 in shape. The intermediate film 3 is interposed between the outer film 1 and the sheet of food 8 and has one longitudinal side edge in register with the corresponding side edges of the outer film 1 and the inner film 2. The portion of the intermediate film 3 which is close to the other side edge thereof extends beneath the discrete incision 15 of the outer film 1 to cover the incision from inside.

Figure 15:
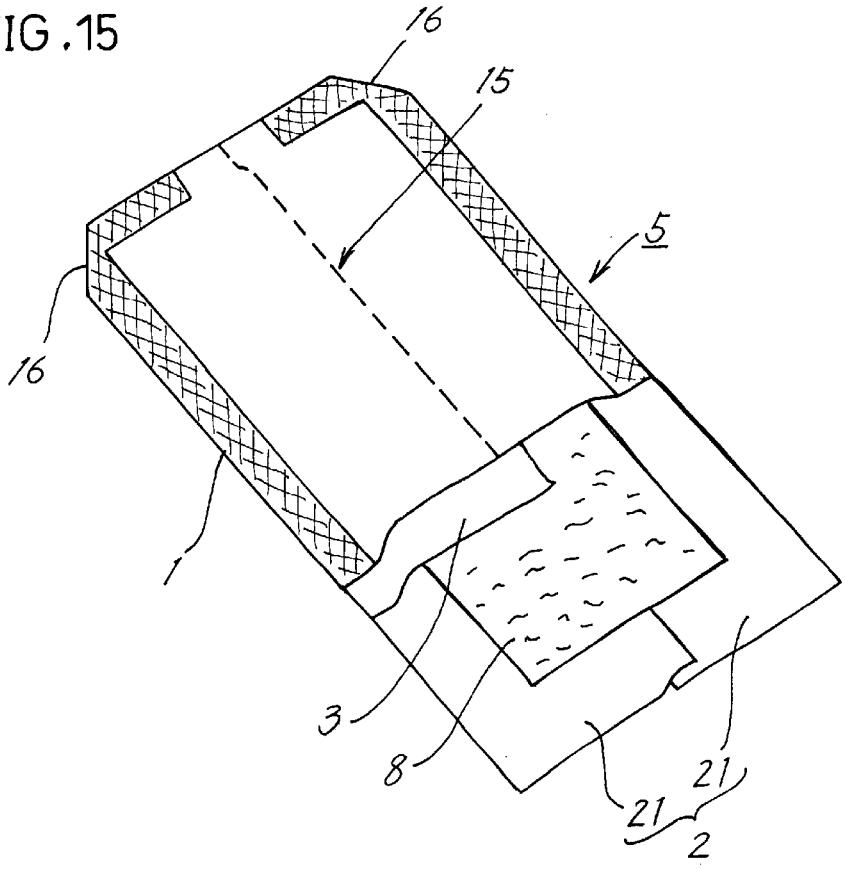
FIG. 15 is a perspective view partly broken away and showing the wrapper.

The wrapper 5 has its outer periphery thermally bonded except at the lap of the film pieces 21, 21 as shown in FIG. 15.

Procedure for Packaging Rice Ball

Figure 16:
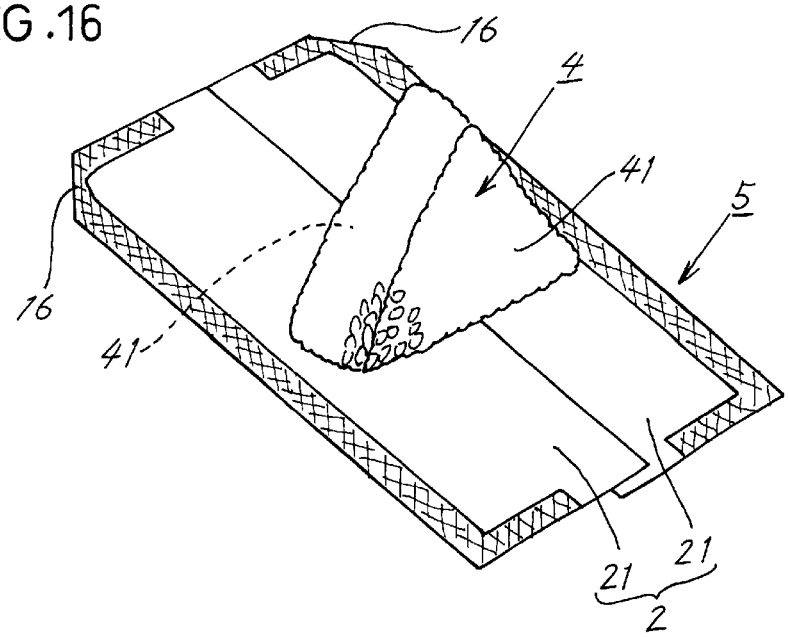
FIG. 16 is a perspective view showing a triangular rice ball as placed on the wrapper.

With reference to FIG. 16, a triangular rice ball 4 is placed in an upright position on the wrapper 5 at the longitudinal midportion thereof, and the wrapper is fitted over opposite triangular surfaces 41, 41 of the rice ball.

Figure 17:
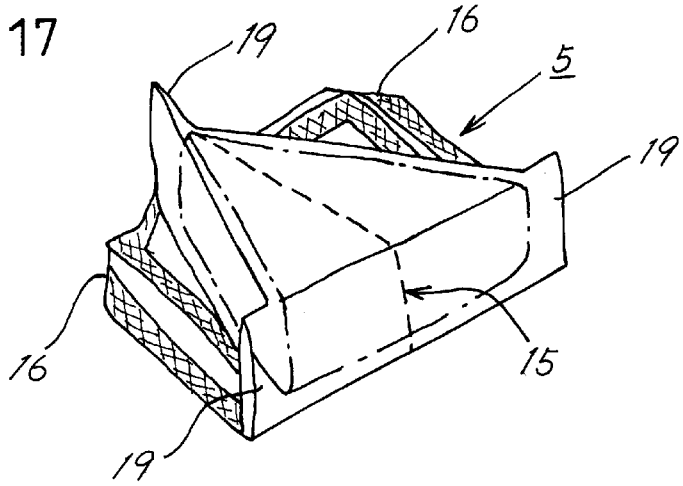
FIG. 17 is a perspective view showing a procedure for packaging the triangular rice ball with the wrapper.
Figure 18:
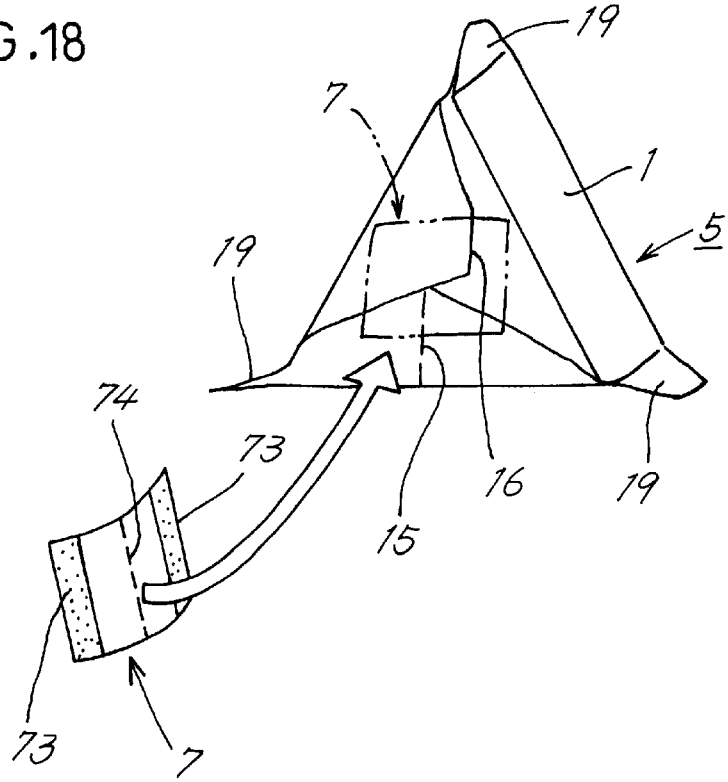
FIG. 18 is a perspective view of the rice ball package prepared and to be labeled.

The uncut end of the wrapper 5 is folded toward and lapped over the wrapper other end having the cut portions 16, 16. Next as seen in FIG. 17, the wrapper 5 is folded over opposite lateral sides of the rice ball 4. The cut ends 16, 16 are then folded over the triangular surface of the rice ball 4 on the opposite side, and a label 7 is affixed to both the folded end and the film portion over the triangular surface as shown in FIG. 18.

The label 7 is provided at opposite ends of the rear surface thereof with respective adhesive layers 73, 73, one of which is fitted over the cut portion 16 of the wrapper 5. The label 7 is centrally formed with a discrete incision 74 in alignment with the incision 15 of the outer film 1.

Figure 19:
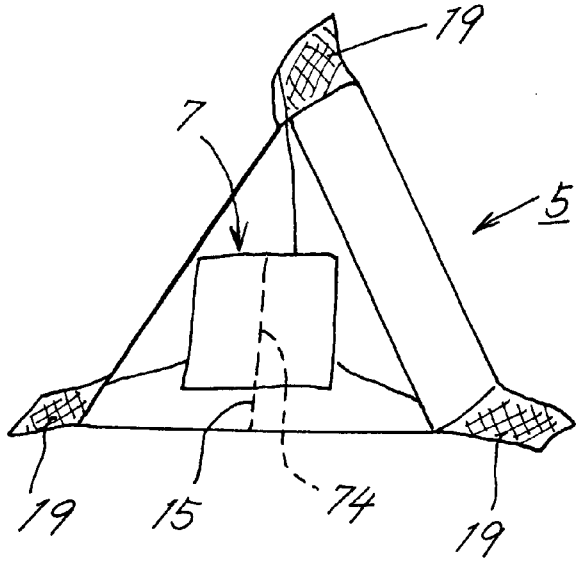
FIG. 19 is a perspective view of the rice ball package with ear portions at three corners sealed off.
Figure 20:
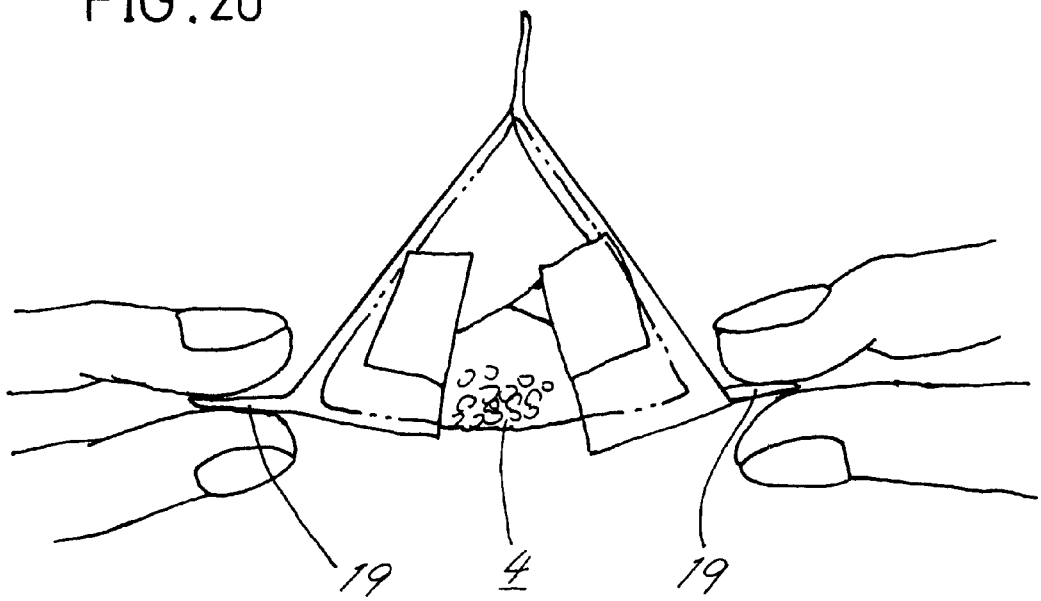
FIG. 20 is a front view showing the rice ball package when it is to be unwrapped by pulling opposite ear portions.
Figure 21:
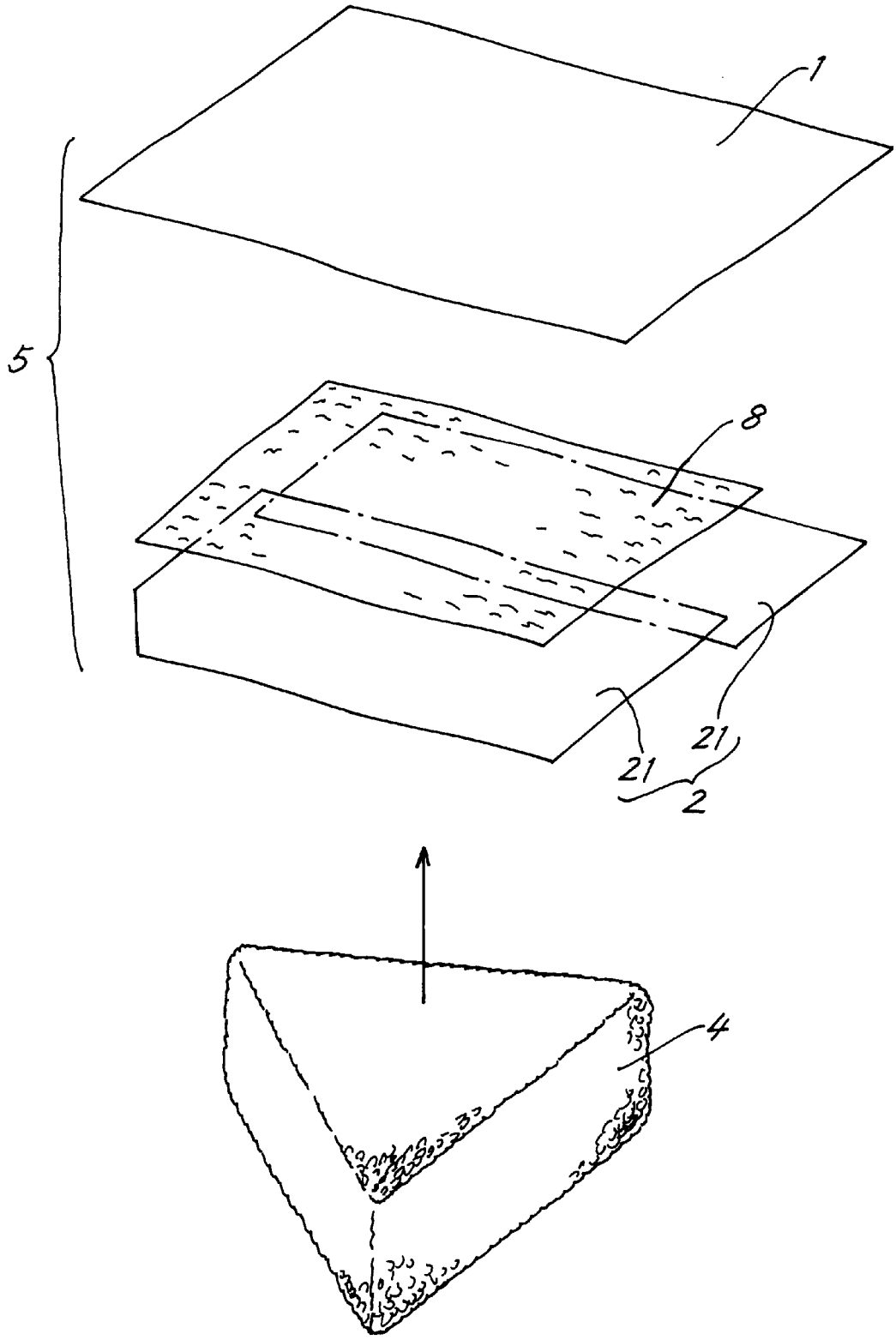
FIG. 21 PRIOR ART
FIG. 21 is an exploded perspective view of a conventional wrapper.

With reference to FIG. 19, the wrapper 5 has ear portions 19 projecting outward from the respective three vertices of the triangular rice ball 4. These ear portions 19 are sealed by thermal bonding to close the openings. This diminishes the likelihood of extraneous matter ingressing into the package through the ear portions 19. If extraneous matter ingresses, a break will be found in the ear portion 19, so that the possibility of eating the rice ball is then avoidable.

The outer film 1 has the discrete incision 15, and the inner film 2 comprises divided two film pieces 21, 21. Accordingly, when the two ear portions 19, 19 are pulled outward away from each other with the hands, the outer film 1 and the inner film 2 are torn apart laterally. The intermediate film 3 is removed from the triangular rice ball 4 along with the outer film piece 1 and the inner film piece 2 to which the film 3 is thermally bonded. The sheet of food 8 only remains to cover the triangular rice ball 4 directly.

Thus, the rice ball package can be opened by the single action of pulling the opposite ear portions 19, 19 outward.

The discrete incision 15, if made in the outer film 1, is likely to permit the outside air to penetrate into the package through the incision 15 and damp the sheet of food 8. According to the present invention, however, the intermediate film 3 extending beneath the incision 15 is interposed between the outer film 1 and the sheet of food 8, whereby the penetration of the outside air through the incision 15 can be precluded effectively.

The wrapper 5 has the cut portion 16 formed by cutting off a corner and finally folded over the triangular surface of the rice ball. Consequently when the label 7 is affixed to both the finally folded portion and the portion of the film 1 outside thereof in packaging the rice ball with the wrapper 5, the label 7 is affixed to the outer film 1 over an area which is increased by an amount corresponding to the cut-off corner of the wrapper. This gives the label 7 increased adhesion to the outer film 1, preventing the label 7 from peeling off inadvertently.

Instead of forming the discrete incisions 15, 74 in the outer film 1 and the label 7 for tearing, the materials per se of the outer film 1 and the label 7 may be made easy to rupture by lateral tensile forces acting in opposite directions. Alternatively, the outer film 1 and the label 7 may be provided with a breaking portion formed as by scoring and easily breakable by lateral opposite tensile forces. In this case, the intermediate film 3 can be dispensed with since the breaking portion is not in communication with the outside air unlike perforations.

What is claimed is:

1. A rice ball wrapper for a triangular rice ball, the rice ball wrapper comprising an outer film, an inner film and a sheet of food sandwiched between the two films, the inner film comprising two film pieces having opposed sides lapping over each other at an approximate widthwise midportion of the wrapper, the outer film being provided at an approximate longitudinal and widthwise central portion thereof with tabs for tearing the film from the central portion to longitudinal opposite ends thereof, the tabs being formed by an incision made in the film through the thickness thereof and being structured to be positioned substantially underneath the rice ball when the rice ball is in an upright position.

2. A rice ball wrapper according to claim 1 wherein the outer film is an oriented film which is easy to tear longitudinally thereof.

3. A rice ball wrapper according to claim 1 wherein a tear tape is joined to the outer film and extends from the tabs to the opposite ends of the film.

4. A rice ball wrapper according to claim 1 wherein an intermediate film is interposed between the outer film and the sheet of food and extends beneath the tabs of the outer film over the entire length of the outer film.

5. A rice ball package comprising a triangular rice ball and a wrapper enclosing therein the triangular rice ball as positioned approximately at a longitudinal midportion of the wrapper and comprising an outer film, an inner film and a sheet of food sandwiched between the two films, the triangular rice ball having one side orthogonal to the longitudinal direction of the wrapper, the inner film comprising two film pieces having opposed sides lapping over each other at an approximate widthwise midportion of the wrapper, the outer film being provided at an approximate longitudinal and widthwise central portion thereof corresponding to a bottom of the triangular rice ball with tabs for tearing the film from the central portion to the longitudinal opposite ends thereof, the tabs being formed by an incision made in the film through the thickness thereof and being positioned on the bottom of the rice ball when the rice ball is in an upright position, a lap of the film pieces of the inner film extending from a vertex of the triangular rice ball toward a midportion of a side thereof opposite to the vertex, a label being affixed to the outer film across the direction in which the tab is to be torn, the distance L from the label to the vertex of the rice ball being made smaller than the distance L1 from the vertex of the rice ball to the midportion of the side thereof opposite to the vertex.

6. A rice ball package according to claim 5 wherein extraneous matter is prevented from ingressing into the package by closing projecting ear portions formed by the wrapper respectively at three corners of the triangular rice ball.

7. A rice ball wrapper for a triangular rice ball, the rice ball wrapper comprising an outer film, an inner film and a sheet of food sandwiched between the two films, the inner film comprising two film pieces having opposed sides lapping over each other at an approximate widthwise midportion of the wrapper, the outer film being an oriented film which is easy to tear longitudinally thereof, the outer film being provided only at an approximate longitudinal and widthwise central portion thereof with a cut line extending longitudinally of the film and made through the thickness thereof, the cut line being structured to be positioned substantially underneath the rice ball when the rice ball is in an upright position.

8. A rice ball wrapper according to claim 7 wherein an intermediate film is interposed between the outer film and the sheet of food and extends beneath the cut line of the outer film over the entire length of the outer film.

9. A rice ball wrapper according to claim 7 wherein the cut line is discrete.

10. A rice ball wrapper according to claim 7 wherein a plurality of parallel cut lines are formed in the outer film.

11. A rice ball package comprising a triangular rice ball and a wrapper enclosing therein the triangular rice ball as positioned approximately at a longitudinal midportion of the wrapper and comprising an outer film, an inner film and a sheet of food sandwiched between the two films, the triangular rice ball having one side orthogonal to the longitudinal direction of the wrapper, the inner film comprising two film pieces having opposed sides lapping over each other at an approximate widthwise midportion of the wrapper, the outer film being an oriented film which is easy to tear longitudinally thereof, the outer film being provided only at an approximate longitudinal and widthwise central portion thereof with a cut line extending longitudinally of the film and made through the thickness thereof, the cut line being positioned substantially on a bottom side of the rice ball when the rice ball is in an upright position, a lap of the film pieces of the inner film extending from a vertex of the triangular rice ball toward a midportion of a side thereof opposite to the vertex.

12. A rice ball package prepared by placing a triangular rice ball on a wrapper approximately at a longitudinal midportion thereof, the wrapper comprising an outer film, an inner film and a sheet of food sandwiched between the two films, covering opposite triangular surfaces of the rice ball with the wrapper, lapping opposite side on one end of the wrapper over opposite sides of the other end of the wrapper, folding the opposite sides of the other end over the rice ball triangular surface on the opposite side thereto, and affixing a label to both the folded end and the triangular surface, the outer film having a discrete incision formed in an approximate widthwise midportion thereof and extending over the entire length of the film longitudinally thereof, the inner film being formed by lapping opposed sides of two film pieces over each other at an approximate widthwise midportion of the wrapper, an intermediate film being interposed between the outer film and the sheet of food and extending beneath the discrete incision of the outer film, the wrapper having a cut portion formed by cutting off a corner and finally folded over the rice ball triangular surface, the label being provided with adhesive layers, respectively at opposite ends of a rear surface thereof, the cut portion of the wrapper being covered with one of the adhesive layers, the label being provided at a central portion thereof with a discrete incision in alignment with the discrete incision of the outer film, the incision of the outer film being positioned substantially on a bottom side of the rice ball when the rice ball is in an upright position, the wrapper being sealed at ear portions thereof projecting outward from three vertices of the triangular rice ball.

* * * * *